United States Patent [19]

Mabuchi

[11] 3,940,882

[45] Mar. 2, 1976

[54] MOTOR-DRIVEN MODEL AIRPLANE HAVING A PUSHER PROPELLER

[75] Inventor: Kenichi Mabuchi, Tokyo, Japan

[73] Assignee: Mabuchi Motor Co. Ltd., Tokyo, Japan

[22] Filed: Nov. 18, 1974

[21] Appl. No.: 524,573

[30] Foreign Application Priority Data

Nov. 21, 1973 Japan ..... 48-130158
Apr. 1, 1974 Japan ..... 49-37226

[52] U.S. Cl. ..... 46/243 AV; 46/76 R; 244/55
[51] Int. Cl.[2] ..... A63H 27/02
[58] Field of Search ..... 46/76 R, 77, 78, 243 AV; 244/55

[56] References Cited

UNITED STATES PATENTS

| | | | |
|---|---|---|---|
| 3,191,888 | 6/1965 | Sklenka | 244/55 |
| 3,757,461 | 9/1973 | Chang et al. | 46/243 AV |
| 3,807,087 | 4/1974 | Staats et al. | 46/243 AV |

*Primary Examiner*—Louis G. Mancene
*Assistant Examiner*—Robert F. Cutting

[57] ABSTRACT

A motor-driven model airplane which is designed to have a pusher propeller to free the fuselage from aerodynamic influences of propeller slip stream and also to protect the fuselage from such damage as would be caused by collision in flight.

12 Claims, 19 Drawing Figures

MOTOR-DRIVEN MODEL AIRPLANE HAVING A PUSHER PROPELLER

BACKGROUND OF THE INVENTION

1. Field of the Invention

The present invention relates to motor-driven model airplanes and, in particular, to battery-powered motor-driven model airplanes of the pusher propeller type having a propeller disposed at the rear of the fuselage.

2. Description of the Prior Art

In the general design of actual airplanes, pusher-type airplanes with propellers behind the tail planes have often been considered because of excellent visibility provided for the pilot, higher safety in landing, taxiing and guidance, and also because of other advantages of these airplanes. In the case of model airplanes, pusher types driven by pusher propellers from behind are also desired because such models are less subject to damage when they collide unexpectedly in flight and also because they are less likely to cause bodily injuries, to operators than those models having a high speed propeller mounted on the nose. Also, the airframes of model airplanes having pusher propellers are free from aerodynamic influences of propeller slip streams, and practical designs for mounting pusher propellers on model airplanes have so far been awaited.

However, designing an engine-driven model airplane using a gasoline engine, which is a well known power source for radio controlled model airplanes, has been regarded as practically impossible.

For a model airplane well stabilized longitudinally and laterally, it is generally desirable to increase the distance between the position of the center of gravity of the entire airframe and the position of the tail plane, or the tail moment arm. In the case of a conventional model airplane driven by a gas engine, if it is a pusher-type model airplane, it is impracticable to mount the engine at the nose of the airframe because this engine would be heavy and the center of gravity would necessarily be shifted backward. In contrast to the above situation, the battery, which is the heaviest component of a model airplane of the present invention, can be mounted at the airframe nose of a pusher-type model airplane to obtain a satisfactorily large tail moment arm and hence high stability. In order to properly locate the center of gravity of the model airplane, it is necessary to mount the heavy engine close to main wings. Suppose that a model airplane, having an engine mounted inside the fuselage to meet the above requirement and a propeller behind the tail plane, is driven by an extension shaft of the engine. A strong mechanical structure will necessarily be required for mounting the propeller this way, in order to withstand the strong torsional force exerted on the propeller shaft and the extension shaft when the engine is started by compression. This means increased weight in the neighborhood of the tail plane and a shorter distance between the main wings and the tail plane and hence reduced longitudinal stability of the airplane.

Also, if the method of starting the engine with a string wound on a pulley attached to the engine output shaft is adopted, the engine cannot be enclosed within the fuselage; an opening with a lid has to be provided to the fuselage so that the opening is closed after the engine has been started, or else the engine is required to be mounted outside the fuselage.

However, an exposed engine mounted outside the fuselage has the particular drawback of being subjected to undesirable air resistance. Also, provision of a starter motor for the engine will mean additional weight of the entire airplane. Also, starting the engine requires not merely revolving the output shaft, but the choke and the needle valve must be adjusted. Because of these problems it has been considered impractical to enclose the engine within the fuselage. An additional requirement is that the radio equipment be spaced from the engine compartment to be free from engine dirt, which naturally constitutes a good deal of difficulty in designing the location of the center of gravity and the main wings. It has been considered practically impossible to build model airplanes with engines mounted inside the fuselages and having pusher propellers.

The present invention will solve these problems by means of a battery-powered, motor-driven model airplane.

In this connection, recently developed nickel-cadmium batteries, provided with gas release valves that act when the batteries are overcharged, are capable of quick charging. Because of their extremely small internal resistance, large discharge current of several amperes or more, relatively small size and light weight for their high current discharge, and quick charging time of a few minutes, these batteries have come into practical service for battery-powered motor-driven model planes.

SUMMARY OF THE INVENTION

It is an object of the present invention to provide a motor-driven model airplane with a pusher propeller behind the airframe.

Another object is to provide a pusher-type motor-driven model airplane having an extension shaft provided with an impact absorber.

A further object is to provide a pusher-type motor-driven model airplane having a motor provided with a cooling fan.

A still further object is to provide a motor-driven model airplane having means for supporting a pusher propeller, said means comprising a cup-shaped member attached to the rear end of the fuselage.

A still further object is to provide a pusher-type motor-driven model airplane having an extension shaft which is free to nutate or rock.

A still further object is to provide a pusher-type motor-driven model airplane having an extension shaft which is adjustable by means of a ball-shaped shaft bearing.

A still further object is to provide a pusher-type motor-driven model airplane having a propeller racing device.

Figure 5:
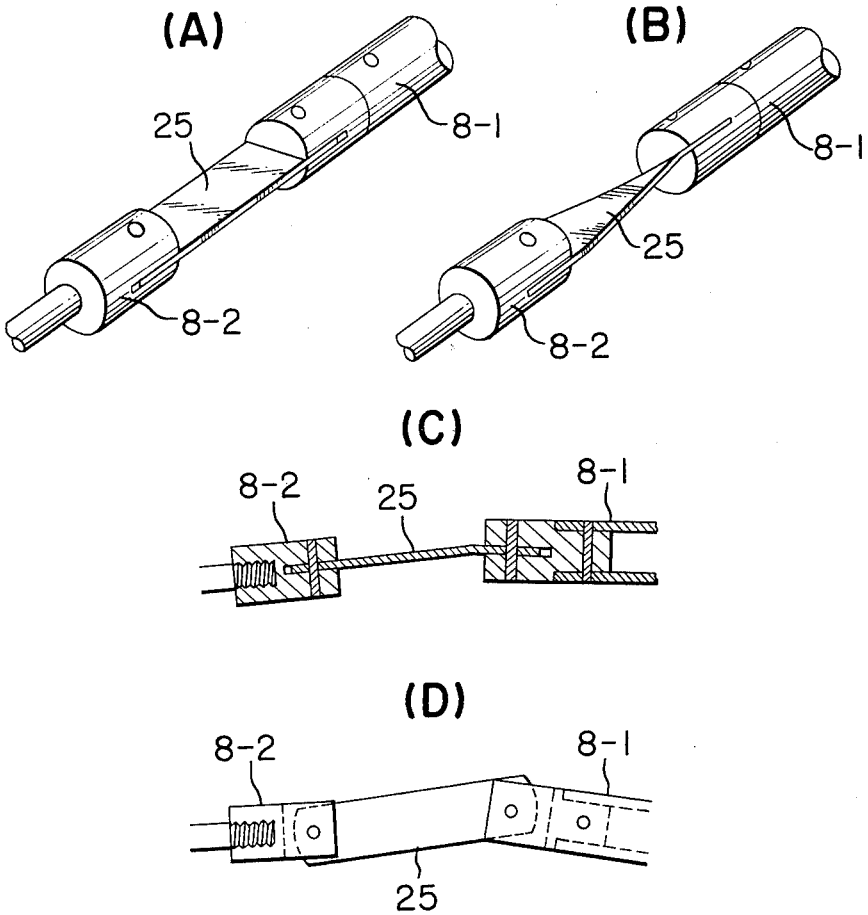

An example of a universal joint which acts as a drive-shaft shock or impact absorber and also serves to align and adjust the drive shaft, is shown perspectively in two contitions in FIGS. 5(A), (B) and in section and elevation in FIGS. 5(C), (D) respectively.

Figure 6:
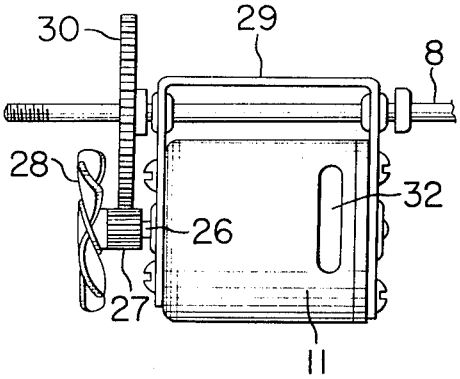

FIG. 6 shows an example of a motor for a motor-driven model airplane, which is provided with a fan for forced air cooling of the motor.

FIGS. 7 through 11 individually show other examples of alternative embodiments.

Figure 12:
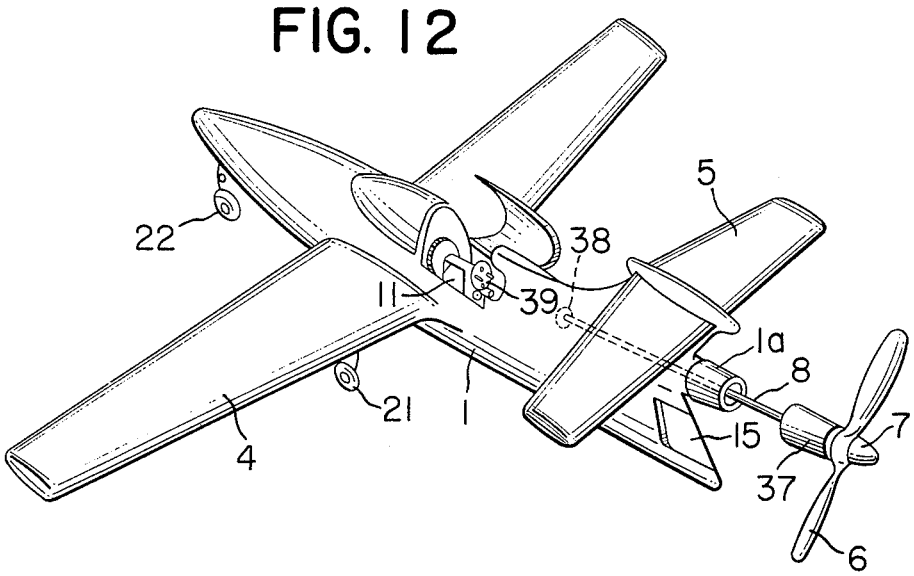

FIG. 12 is a general perspective view of another motor-driven model airplane with a pusher propeller, which also embodies the present invention.

Figure 13:
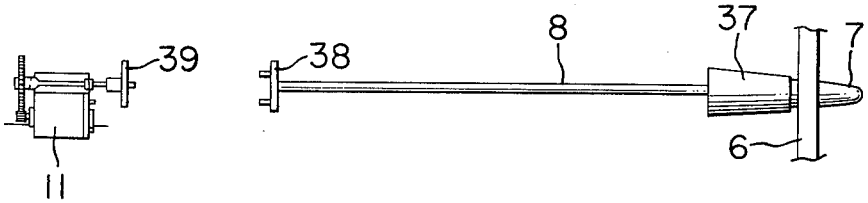

FIG. 13 is an exploded side view illustrating the engagement of the extension shaft and the drive shaft of the motor employed in the model airplane in FIG. 12.

Figure 14:
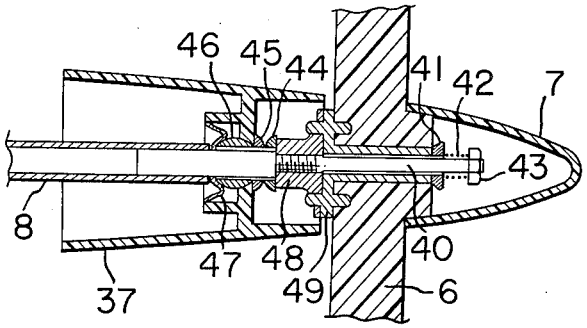

FIG. 14 is a cross-section of a cup-shaped member used in the model airplane in FIG. 12 and shows the arrangement of bearing means, extension shaft, and the propeller.

Figure 15:
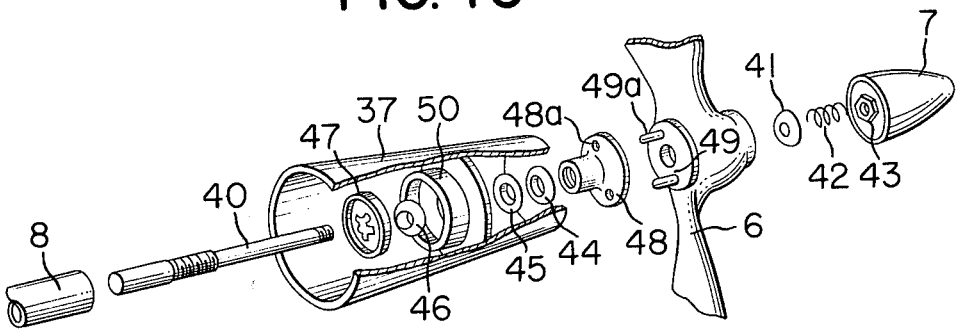
Figure 16:
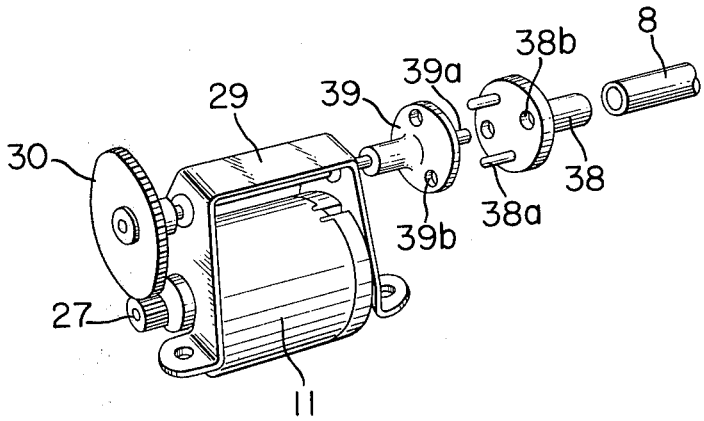

FIG. 15 is an exploded perspective view of the cup-shaped member shown in FIG. 14, and FIG. 16 is an exploded view of the coupling of the extension shaft and the drive shaft of the motor in the example shown in FIG. 12.

DETAILED DESCRIPTION OF THE EMBODIMENTS OF THE INVENTION

A motor-driven model airplane with a pusher propeller, which is shown as an example of the present invention, has a fuselage 1, a nose 2, main wings 3 and 4, horizontal tail planes 5, a rudder fin 15, and a pusher propeller 6. The propeller 6, having a spinner-cap 7, is mounted for rotation on a propeller extension shaft 8. Between the propeller 6 and the extension shaft 8 are provided a universal joint 9 and a ball-shaped bearing 10 for easier alignment of the propeller 6 and the extension shaft 8, and between the extension shaft 8 and a drive motor 11 are provided a revolving shaft impact or shock absorber (comprising elements 23 and 24 as will be illustrated later in FIGS. 3, 4, and 5 and a reduction gear 12. Reference character 13 represents a push-rod for moving the rudder fin 15, and one end of the rod 13 is attached to the rudder fin 15 and the other end to a servo mechanism 16 including a radio control receiver. A battery (nickel-cadmium battery) cassette 17 for powering the above drive motor 11 and the radio receiver is provided and, if required, a noise filter 18 is also provided in the neighborhood of the battery 18. Reference character 19 is an antenna for radio control reception. An ON/OFF switch 20 is provided for an electric circuit connecting the cassette 17 and the drive motor 11. Reference character 21 is a main wheel, and reference character 22 is a nose wheel.

In the case of the present invention, the recent development of small-sized, high-output batteries makes it possible to realize battery-powered motor-driven model airplanes, leading to the first embodiment of a model airplane of this type having a pusher propeller.

In a model airplane of this type, the position of the center of gravity is determined mainly by the prime mover for driving the propeller and the energy source for said prime mover, and the position may be made slightly adjustable by means of the servo mechanism.

In the case of the present invention, the above conditions will be met by locating the battery cassette 17 near the nose 2 and correspondingly mounting the drive motor 11 at the proper position. This means that the drive motor 11 is positioned close to the center portion of the fuselage 1, i.e., near the main wings 3, 4 for better longitudinal stability of the fuselage 1.

In this way the motor 11, which can be started simply by turning ON the switch 2, may be mounted within the fuselage 1, and this solves all the difficult problems encountered by an attempt to drive a pusher propeller 6 by a conventional gasoline engine. The fact that the weight of the battery cassette 17 does not change with the consumption of battery energy makes it possible to place the battery cassette 17 close to the nose 2. The motor 11 is provided with the extension shaft 8 and therefore can be located near the center of the fuselage 1 to increase the distance between the main wings 3 4 and the tail plane 5, making it possible to design an airframe with high longitudinal stability. Through introduction of the pusher propeller, which is now made possible by the present invention, the fuselage 1, particularly the main wings 3 4 and the tail plane 5, are free from adverse aerodynamic influences of turbulent airflow caused by the slip stream of the propeller. The propeller efficiency can also be much higher because no resistance is present to the thrust behind the propeller. In this way, the present invention provides a model airplane that is much more stable and flies much better than models having tractor type propellers. In addition, impact absorbing means, such as rubber, may be provided at the nose 2 for protection against damage from colliding with trees or poles. The propeller 6 is also substantially safe from damage. This is, so to speak, a model airplane with ideal safety.

Figure 1:
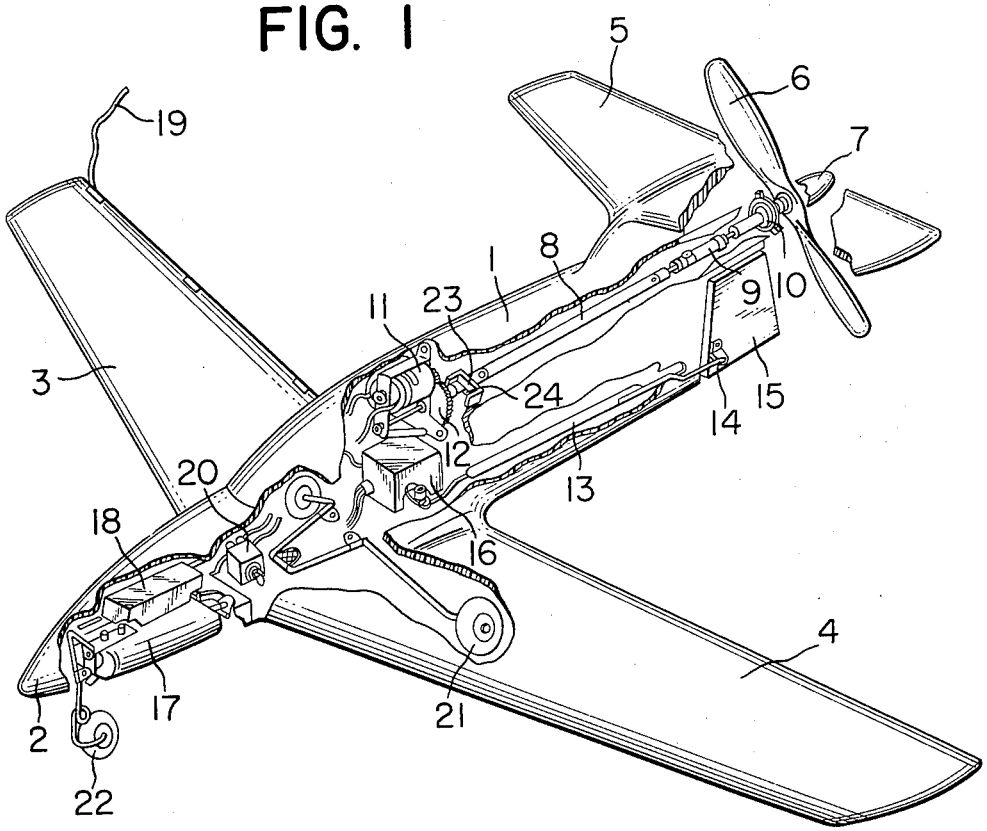
FIG. 1 is a perspective view of a motor-driven model airplane with a pusher propeller which embodies the present invention, and in which the airframe is partly cut away by way of illustration.
Figure 2:
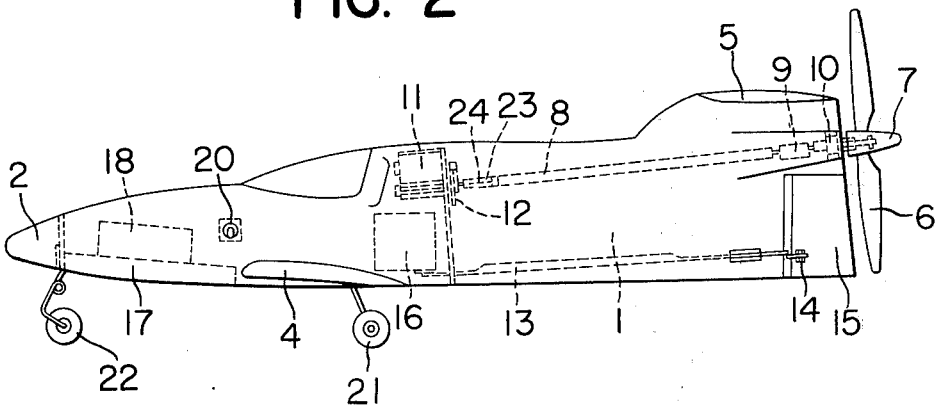
FIG. 2 is a side elevational view of the model airplane shown in FIG. 1.
Figure 3:
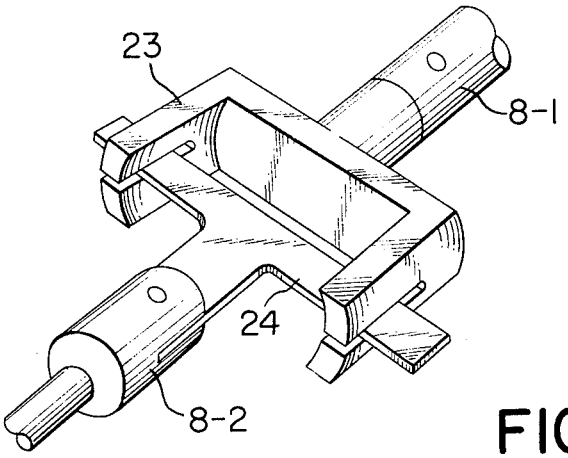
FIGS. 3 and 4 are perspective and transverse sectional elevational views, respectively, of a drive shaft shock or impact absorber embodying the present invention and illustrating how shock is absorbed.
Figure 4:
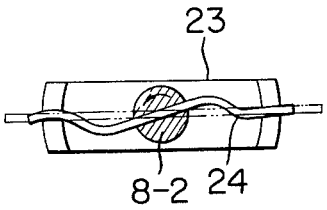

FIG. 3 and FIG. 4 show an impact absorber designed for cushioning the impact on the propeller drive shaft when the motor 11 is being started. 8-1 designates the shaft 8 on the side of the propeller 6; 8-2 the shaft 8 on the side of the motor 11; and 23 and 24 form the impact absorber for the drive shaft. 23 is a frame member which may be a rigid body, and 24 represents a T-shaped member made of resillient material. When the switch 20 in FIG. 1 and FIG. 2 is turned ON, the motor 11 immediately starts revolving at very high speed, and an extremely large torque is applied to the extension shaft 8. In the case of the present invention, the impact absorber 23 and 24 is provided to cushion this impact as shown in FIG. 4, illustrating the T-shaped elastic member 24 being deflected to reduce the very large torque temporarily generated. Also, when the axes of the shafts 8-1 and 8-2 are slightly out of alignment, this can be corrected by the T-shaped member 24 which will move slightly rightward or leftward within the slots of the frame member 24.

FIGS. 5(A), (B), (C), and (D) show a universal joint which may be used with or in place of the above described shock absorber. It consists of a resillient blade 25 inserted between the shafts 8-1 and 8-2 to have its torsional flexibility reduce the impact on the shafts in a manner such that the angular difference between the revolutions of the shafts 8-1 and 8-2 is absorbed by this torsional deflection. The blade 25 will also correct misalignment of the axes of the shafts 8-1 and 8-2 as shown in FIG. 5(C), because both ends of the blade 25 are supported by these shafts. This blade 25 may also be pivotally supported by the shafts 8-1 and 8-2 to be rotational edgewise, as shown in FIG. 5(D).

As described above, in a motor-driven model airplane of the present invention having a small-sized but high-output battery as its energy source, the motor is installed within the fuselage 1 because it can be started by simply turning ON the switch 2, and the motor 11 can also drive from this position the pusher propeller 6 through the extension shaft 8, while the center of gravity of the model airplane is still maintained at the forward part of the fuselage 1. The present invention thus makes it possible to provide a model airplane with outstanding stability and flying capability as well as high safety. Also, it is generally the case with a model airplane of this type that the air resistance of the main wings 3 4 combined with the propelling force of the propeller 6 tends to generate a turning torque which, in the case of FIG. 2, is in a direction to push the fuselage nose 2 downward. To correct this tendency, it is necessary that the revolving axis of the propeller 6 be slightly inclined rather than horizontal. The impact absorbers 23, 24 and 25 and the universal joint 9 facilitate this adjustment, and they also can absorb the high torque when the motor starts.

However, the above described pusher-type battery-powered model airplane still has technical problems to be solved. In the case of a conventional tractor-type motor-driven model airplane, the propeller attached to the airframe nose can directly air cool the motor by the propeller slip stream as well as by air flowing around the motor as the model airplane advances. But, it is not desirable for a pusher-type model airplane to mount the motor at the nose even where an extension shaft is provided to the motor. Therefore, in comparison with the case of a tractor-type model airplane that can utilize the propeller slip stream, it is difficult for this pusher type to make up for the absence of the motor cooling air obtainable from the tractor-type propeller, even if the air flowing over the advancing fuselage is directly used to cool the motor. In a battery-powered system, high motor output is required in such cases as where a model airplane is operated by radio control, and the resultant heat generation in the motor would make it difficult to maintain the high power output in these cases, which makes it very desirable to provide an efficient cooling means for the motor. This cooling means will be described below as examples of forced air cooling fans to be attached to the motor 11 of FIG. 1 and FIG. 2, by referring to FIGS. 6 through 11.

In FIG. 6, a pinion gear 27 and a forced air cooling fan 28 are fastened to a power drive shaft 26 of the motor 11, and the motor 11 is provided with a gear frame 29 which is fastened to the motor body. The gear frame 29 carries the extension shaft 8 mounting a spur gear 30 to engage with the pinion gear 27. As the motor shaft 26 revolves, the fan 28 also will revolve to effect forced air cooling of the motor 11 by forcing air through air inlet openings 31 and air outlet openings 32.

Figure 7:
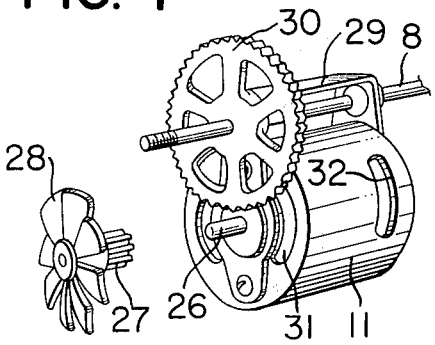
Figure 8:
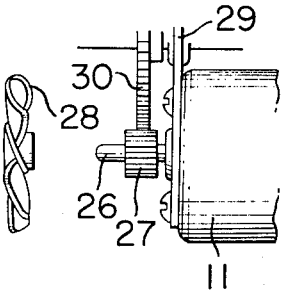
Figure 10:
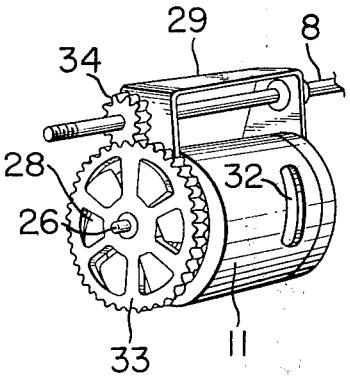
Figure 9:
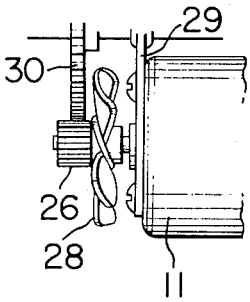
Figure 11:
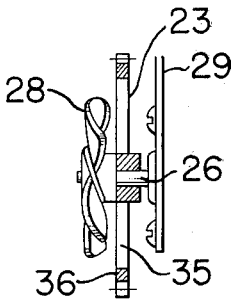

FIG. 7 shows an integrally molded pinion gear 27 and fan 28 of, for example, synthetic resin, which will simplify the assembling process substantially reducing the cost of quantity production. FIG. 8 shows the pinion gear 27 and the fan 28 separately molded, and FIG. 9 illustrates a case where the fan 28 is mounted on the motor side of the pinion gear 27. FIG. 10 and FIG. 11, respectively, show embodied examples of cases where the revolving speed of the shaft 8 is increased by means of gears. In FIG. 10, a gear 33 having an integrally molded fan 28 is fastened to the motor shaft 26, and the gear 33 engages with a speed increasing gear 34 to increase the revolving speed of the extension shaft 8. In FIG. 11, a spur gear 36 having large ventillation openings 35 is fastened to the motor shaft 26 and engages with a speed increasing gear which is not illustrated. The cooling fan 28 is also mounted on the motor shaft 26.

As described above, in a pusher-type motor-driven model airplane enclosing a motor within the fuselage to reduce air resistance, a forced air cooling fan is provided to the motor to prevent excessive temperature rise in the battery-powered drive motor, thereby maintaining high motor efficiency. In particular, because of the difficulty of these model airplanes to efficiently utilize wind produced by flight, the increased resistance of the motor coil will directly cause the driving current to decrease. However, the above described examples of the present invention can solve all these problems merely be adding a forced air cooling fan of very simple construction.

Where the propeller is driven via an extension shaft, the extension shaft must be supported by bearings at one or both ends, requiring a good deal of attention to adjusting the direction of the drive shaft of the propeller. In the embodied examples shown in FIGS. 12 through 15, the axes of the extension shaft 8 and the propeller 6 are fixedly set to coincide in a straight line, and a cup-shaped member is provided as a means of providing a bearing at the rear end of the fuselage such that the extension shaft 8 is free to rock against the bearing to adjust the direction of the drive shaft of the propeller.

In FIG. 12, 8 represents the extension shaft driving the propeller 6, 37 a cup-shaped member having bearing means in the interior and tightly fitted to a hollow or tubular end 1*a* of the fuselage 1. 38 and 39 represent, respectively, a joint on the propeller side and another on the motor side which engage with each other. As shown in FIG. 13, coupling between the motor 11 and the extension shaft 8 connected to the propeller 6 is accomplished by having the projections and depressions of the propeller-side joint 38 engage respectively with the depressions and projections of the motor-side joint 39. Details of the construction of these joints are illustrated in FIG. 16.

FIG. 14 and FIG. 15 show the interior structure of the above cup-shaped member 37 shown in FIG. 12 and FIG. 13. In FIGS. 14 and 15, 40 is a propeller shaft, 41 a washer, 42 a compression spring, 43 a nut, 44 and 45 washers, 46 a ball-shaped bearing, 47 a bearing mount supporting the ball-shaped bearing 46, 48 a propeller seat, and 49 is a racing shaft integral with the propeller 6, 48*a* represents holes provided in the propellers seat 48 to receive projections 49*a* of the racing propeller racing shaft 49.

As expressly illustrated in FIG. 14 and FIG. 15, the axes of the extension shaft 8 and the propeller shaft 40 are in fixed coincidence with each other and the cup-shaped member 37 is retained by the surface of the ball-shaped bearing 46 via the bearing seat 47. The bearing 46 and the shaft 8 can rock or nutate about the center of the bearing seat 47. In this configuration, the extension shaft 8, which is connected to the propeller 6 and runs through the ball-shaped bearing 46 is permitted to make rocking movement together with the ball-shaped bearing 46 against the cup-shaped member 37 while it is also supported to be free to revolve, making it possible to change the direction of the drive shaft of the propeller with respect to the fuselage 1, with the cup-shaped member 37 tightly fitted in the hollow rear end (1*a*, in FIG. 12) of the fuselage 1.

In the above described example, the motor mounting position can be adjusted after the cup-shaped member 37 has been fitted to the hollow rear end 1*a* of the fuselage 1, meaning that for this adjustment the extension shaft 8 can freely rock within the cup-shaped member 37, i.e. in the fuselage 1, to facilitate the adjustment of the axis of propeller revolution with respect to the center of gravity of the airframe 1. This makes it possible to obtain optimum conditions for flying. As shown in FIG. 12, the simple attachment of a lid that simulates the cockpit canopy for example, which can be opened and closed, to the portion of the fuselage 1 above the motor 11 will make it possible to adjust the mounting position of the motor 11 and also to couple the extension shaft 8, which is connected to the propeller 6, to the motor 11 with ease.

In addition, the above described construction has a provision for propeller racing. While in powered flight, the propeller 6, being pushed forward by the washer 41, the spring 42, and the nut 43 and also by its own propelling force, is in positive engagement with the propeller seat 48 to be driven by the extension shaft 8. When the power output of the motor 11 drops, the force of air resistance applied to the propeller 6 will urge the above spring 42 backward, causing the projections 49*a* of the propeller racing shaft 49 to withdraw from the propeller seat 48 to permit the propeller 6 to windmill. In this way, the propeller 6, responding to the forward movement of the fuselage 1, can be set free to race and decrease the air resistance, so that the model airplane in flight be least subject to undesirable air resistance.

FIG. 16 illustrates the way the motor drive shaft and the extension shaft 8 connected to the propeller are coupled as described above, showing the spur gear 30, the pinion gear 27, the gear frame 29, projections 38*a* and depressions 38*b* of the propeller-side joint 38, and projections 39*a* and depressions 39*b* of the motor-side joint 39. The projections 38*a* of the propeller-side joint 38 can engage with and withdraw from the depressions 39*b* of the motor-side joint 39, and the projections 39*a* of the motor-side joint 39 can engage with and withdraw from the depressions 38*b* of the propeller-side joint 38. The propeller-side joint 38 is tightly fixed to the extension shaft 8.

Thus the above described engagement between the propeller-side joint 38 and the motor-side joint 39 enables the extension shaft 8 connected to the propeller 6 to transmit the revolution of the motor 11 to the propeller 6.

What is claimed is:

1. A model airplane comprising a fuselage adapted to contain a battery, a battery driven motor having an extension shaft and pusher-type propeller mounted on and driven by said extension shaft at a location behind the tail of said airplane, the rear of said fuselage further including a hollow cylinder-shaped member and a cup-shaped member tightly fixed to said cylinder-shaped member, said cup-shaped member having bearing means in the interior thereof, said extension shaft being permitted to rock on said bearing means and a propeller racing device.

2. The model airplane according to claim 1, wherein said extension shaft between said propeller and said motor is provided with at least one impact absorber to absorb impacts or shocks.

3. The model airplane according to claim 1, wherein said motor is mounted in the interior of said fuselage and wherein there is further provided for said motor a forced cooling fan.

4. The model airplane according to claim 1, wherein said bearing means is tightly fixed relative to the rear of said fuselage, said extension shaft being connected to said propeller and wherein there is further provided an extension-shaft coupler for detachably connecting said extension shaft to the output shaft of the motor.

5. The model airplane according to claim 1, wherein said extension shaft is connected to said propeller and runs through said cup-shaped member and said bearing means has a spherical surface and is mounted on said extension shaft, said cup-shaped member being carried on said spherical surface of said bearing means, said cup-shaped member and said bearing means being coupled together by means of a bearing holder.

6. The model airplane according to claim 1, wherein there are provided a propeller setter fixedly mounted on said extension shaft, said propeller being rotatably supported with respect to said extension shaft and adapted to be fixedly connected to said extension shaft by engaging with said propeller setter, a stopper attached to the propeller-side rear end of said extension shaft and a spring coil between said propeller and said stopper.

7. A model airplane comprising a fuselage adapted to contain a battery, a battery driven motor having an extension shaft and a pusher-type propeller mounted on and driven by said extension shaft at a location behind the tail of said airplane, there being further included bearing means tightly fixed relative to the rear of said fuselage, said extension shaft being connected to said propeller and an extension-shaft coupler for detachably connecting said extension shaft to the output shaft of said motor.

8. The model airplane according to claim 7, wherein said extension shaft between said propeller and said motor is provided with at least one impact absorber to absorb impacts or shocks.

9. The model airplane according to claim 7, wherein said motor driving said propeller is mounted in the interior of said fuselage and wherein there is also provided for said motor a forced cooling fan.

10. The model airplane according to claim 7, wherein there are provided a propeller setter fixedly mounted on said extension shaft, said propeller being supported rotationly with respect to said extension shaft and adapted to be fixedly connected to said extension shaft by engaging with said propeller setter, a stopper attached to the propeller-side rear end of said extension shaft and a spring coil between said propeller and said stopper.

11. A model airplane comprising:

a fuselage;

main wings secured to said fuselage;

a battery located near the nose of said fuselage;

a motor mounted close to said main wings and driven by said battery;

an extension shaft driven by said motor;

a bearing for said extension shaft, said bearing being positioned at the rear end of said fuselage;

a pusher-type propeller mounted on and driven by said extension shaft at a location behind the tail of said airplane; and means for setting the axis of propeller revolution to said fuselage, and said propeller being so mounted that the axis of propeller revolution is substantially directed to the center of gravity of the airplane.

12. A motor-driven model airplane of claim 11, wherein the extension shaft between the propeller and the motor is provided with at least one impact absorber to absorb impact or shocks, and said impact absorber also comprises said means for setting the axis of propeller revolution.

* * * * *